US008690575B1

(12) United States Patent
Gurule et al.

(10) Patent No.: US 8,690,575 B1
(45) Date of Patent: Apr. 8, 2014

(54) APPARATUS AND METHOD FOR A WEAPON SIMULATOR

(75) Inventors: Randall S. Gurule, Albuquerque, NM (US); Douglas D. Sutton, Albuquerque, NM (US); E. Victor Maestas, Placitas, NM (US); Peter Agnew, Albuquerque, NM (US); Matthew Hastey, Albuquerque, NM (US); Michael T. Skelton, Albuquerque, NM (US)

(73) Assignee: ACME Worldwide Enterprises, Inc., Albuquerque, NM (US)

( * ) Notice: Subject to any disclaimer, the term of this patent is extended or adjusted under 35 U.S.C. 154(b) by 505 days.

(21) Appl. No.: 12/611,420

(22) Filed: Nov. 3, 2009

Related U.S. Application Data

(60) Provisional application No. 61/110,753, filed on Nov. 3, 2008.

(51) Int. Cl.
*F41G 3/26* (2006.01)

(52) U.S. Cl.
USPC ..... 434/18; 434/11

(58) Field of Classification Search
USPC ..... 434/11–26; 463/49; 703/7
See application file for complete search history.

(56) References Cited

U.S. PATENT DOCUMENTS

| | | | | |
|---|---|---|---|---|
| 2,398,813 | A | | 4/1946 | Swisher |
| 2,508,577 | A | | 5/1950 | Maeser |
| 2,520,281 | A | | 8/1950 | Heide |
| 2,729,975 | A | | 1/1956 | Hawthorne et al. |
| 2,991,781 | A | | 7/1961 | Ayala |
| 3,403,669 | A | | 10/1968 | Crosman |
| 4,007,934 | A | | 2/1977 | Ochi |
| 4,050,166 | A | | 9/1977 | Swiatosz et al. |
| 4,079,525 | A | | 3/1978 | Linton et al. |
| 4,321,043 | A | * | 3/1982 | Grimmer et al. ..... 434/18 |
| 4,365,959 | A | | 12/1982 | Caurant et al. |
| 4,591,342 | A | | 5/1986 | Lipp |
| 4,654,008 | A | * | 3/1987 | Elmore ..... 434/16 |
| 5,988,645 | A | * | 11/1999 | Downing ..... 273/348 |
| 6,019,681 | A | * | 2/2000 | Oishi et al. ..... 463/49 |
| 6,269,730 | B1 | | 8/2001 | Hawkes et al. |
| 6,604,064 | B1 | * | 8/2003 | Wolff et al. ..... 703/7 |
| 7,415,790 | B1 | * | 8/2008 | Ruhland et al. ..... 42/94 |
| 7,510,477 | B2 | | 3/2009 | Argentar |
| 2006/0204935 | A1 | | 9/2006 | McAfee et al. |
| 2007/0067138 | A1 | * | 3/2007 | Rabin et al. ..... 702/150 |
| 2008/0187888 | A1 | * | 8/2008 | Jones et al. ..... 434/21 |
| 2009/0253103 | A1 | * | 10/2009 | Hogan, Jr. ..... 434/24 |
| 2010/0099059 | A1 | * | 4/2010 | Burford ..... 434/16 |

FOREIGN PATENT DOCUMENTS

| | | |
|---|---|---|
| GB | 2 268 252 | 1/1994 |
| JP | 20000042244 | 2/2000 |

* cited by examiner

*Primary Examiner* — Timothy A Musselman

(74) *Attorney, Agent, or Firm* — Peacock Myers, P.C.; Janeen Vilven

(57) ABSTRACT

The present invention is a weapon simulator that is at least partially controlled by a host computer and simulates near actual recoil forces of a weapon via a gun active recoil unit.

25 Claims, 10 Drawing Sheets

APPARATUS AND METHOD FOR A WEAPON SIMULATOR

CROSS-REFERENCE TO RELATED APPLICATIONS

This application claims priority to and the benefit of the filing of U.S. Provisional Patent Application Ser. No. 61/110,753, entitled "Apparatus and Method for a Weapon Simulator", filed on Nov. 3, 2008, and the specification thereof is incorporated herein by reference.

BACKGROUND OF THE INVENTION

1. Field of the Invention (Technical Field)

Embodiments of the present invention relate to weapon simulator systems and more specifically to gun active recoil simulators.

2. Description of Related Art

Previous weapon simulator systems replicate recoil cue and fail to replicate near actual recoil forces. One aspect of one embodiment of the present invention over other stimulated recoil solutions provides an electronic solution and does not wear the internal gun mechanism. Previous recoil systems used pneumatics to provide simulated recoil. The pneumatic solution requires air hoses and a separate air compressor to provide power for the pneumatic mechanisms. Also, the pneumatic systems use a mechanism that is inserted into the gun and activates the internal gun mechanism when it provides recoil. This action adds wear and stress to mechanisms that the embodiments of the present invention avoid.

One embodiment of the present invention actuates the gun mount instead of the internal gun mechanism to provide simulated recoil. In this embodiment, a gun is attached to the mount as it moves with the actuated mount. Embodiments of the present invention do not require any device to be mounted internal to an actual gun and do not add any wear to the gun. Embodiments of the present invention also do not require any bolt action. The present invention also permits the operator to use either an actual gun or a simulated gun (replica look and feel without any internal mechanisms).

SUMMARY OF THE INVENTION

One embodiment of the present invention comprises a weapon simulator. The weapon simulator preferably comprises a gun active recoil unit comprising a slide tray and at least one motor, a gun mounted to said gun active recoil unit, said gun comprising a trigger, and a host computer in communication with said gun active recoil unit. The gun is preferably mounted to the slide tray. The gun active recoil unit preferably comprises a plurality of mounting pintles and a plurality of adjustable stops. The adjustable stops preferably adjust elevation and azimuth. The gun active recoil unit of this embodiment preferably comprises an electronic chassis. The gun of this embodiment of the present invention can be either a replica weapon or an actual weapon. The gun can optionally comprise a safety. The host computer preferably comprises a plurality of malfunction capabilities for the weapon simulator. The trigger on the gun preferably comprises a hard stop to limit an amount of travel while the weapon simulator is activating. The weapon simulator of this embodiment preferably comprises a muzzle flash and/or simulated ammunition.

Another embodiment of the present invention comprises a method of simulating weapon recoil with a weapon simulator. This embodiment preferably comprises providing a gun mounted to a gun active recoil unit, squeezing a trigger on the gun to generate a signal, transmitting the signal from the gun to a host computer in communication with the gun active recoil unit, the gun active recoil unit responding to the signal from the host computer, and simulating recoil via a slide tray disposed on the gun active recoil unit. The method of this embodiment preferably further comprises the gun active recoil unit initiating electromechanical motions. The transmitting step preferably comprises processing the signal via an onboard computer. This method preferably further comprises the host computer initiating one or more malfunctions. These malfunctions can be selected from the group consisting of: a runaway recoil, weapon misfire, weapon sluggishness and round cook-off. The method of this embodiment can optionally comprise signaling a cease fire and/or activating a safety wherein the trigger will not depress and/or adjusting the weapon simulator using azimuth and elevation. The host computer can optionally override the safety to simulate cook-off rounds. The maximum rate of fire is preferably between approximately 750-1000 rounds per minutes. In this embodiment, an instructor can optionally initiate gun active recoil unit and/or gun activity through the host computer.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1A:
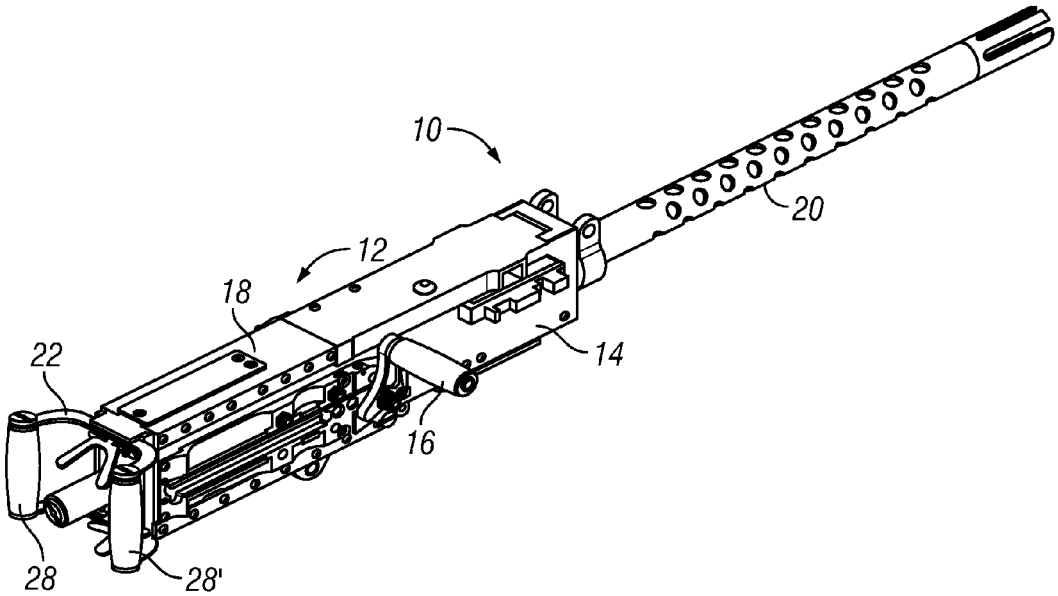
FIG. 1A-1D illustrate an embodiment of the present invention comprising a gun.

As used throughout the specification and claims, "gun" is defined as any type of projectile weapon whether real or simulated or a replica. As used throughout the specification and claims, "a" means one or more.

One embodiment of the present invention is a weapon simulator comprising a gun active recoil unit that is designed for training with realistic recoil when firing simulated projectile weapons. Training with realistic recoil enables a trainee that is operating weapon having recoil a gun to anticipate and adapt to the recoil forces in order to keep the aiming point of the weapon on target just as is required in the real world. The weapon simulator of this embodiment replicates near actual recoil forces, and not just recoil cue indicating the firing of a weapon. Further, the weapon simulator realistically replicates recoil motion, frequency and intensity. The weapon simulator is adaptable to any small arms weapon or trainer and works directly with existing weapon system trainers and/or simulator firing signals. This embodiment further supports instructor-inserted motion malfunctions, jams, duds and out of ammunition. The weapon simulator preferably comprises electric motors that eliminate the need to use expensive blank rounds and maintain intensive pneumatic systems. The weapon simulator preferably includes variable intensity to fine tune recoil, easy access to system components for maintenance and tuning, and ruggedized systems that can adapt actual weapons for field use.

In an embodiment of the present invention, a gun active recoil unit is tailored to actuate an entire weapon. In an alternative embodiment, a gun active recoil unit can be designed to actuate on the weapon handles for use in virtual reality systems where the weapon body is presented as a computer image.

In another embodiment of the present invention, a weapon simulator preferably comprises a gun, a gun active recoil unit and associated mounting and electronics components. In this embodiment, the weapon simulator can be used with any gun on any type of mount.

In a preferred embodiment of the present invention, the weapon simulator comprises a XM218 weapon simulator. The weapon simulator further comprises simulated .50 caliber machine gun (the Gun) 10, as illustrated in FIGS. 1A-1D. The system also preferably comprises gun active recoil unit 50, and associated mounting and electronics components 36, as illustrated in FIGS. 2A-2C. The weapon simulator of this embodiment is preferably designed to combine a high fidelity replication of the XM218 weapon with articulated operator controls and an all-electric, simulated recoil system. This combination provides a highly realistic simulation of an actual weapon firing including accurate interface and controls, loads, forces, and feedback to the user. The system of this embodiment is preferably designed as an integral component of the CH-46 and CH-53 airborne gunnery trainer produced by Pathfinder Systems, Inc., see FIGS. 4-7.

In yet another embodiment of the present invention, a XM218 weapon simulator comprises high fidelity replication of the external features of an actual XM218. The simulator further comprises a weapon charging handle and a trigger with a firing signal switch that has accurate force feedback and feel. This embodiment further comprises a weapon safety with signal switch and articulated weapon top cover assembly. There is also preferably a weapon mounting system.

In a further embodiment of the present invention, the weapon simulator comprises a replica weapon or an actual weapon (gun 10), gun active recoil unit 50 and a host computer. The host computer can be either remote from the weapon simulator or can be located on the weapon simulator. The host computer can also comprise an onboard computer.

The Gun

Figure 1B:
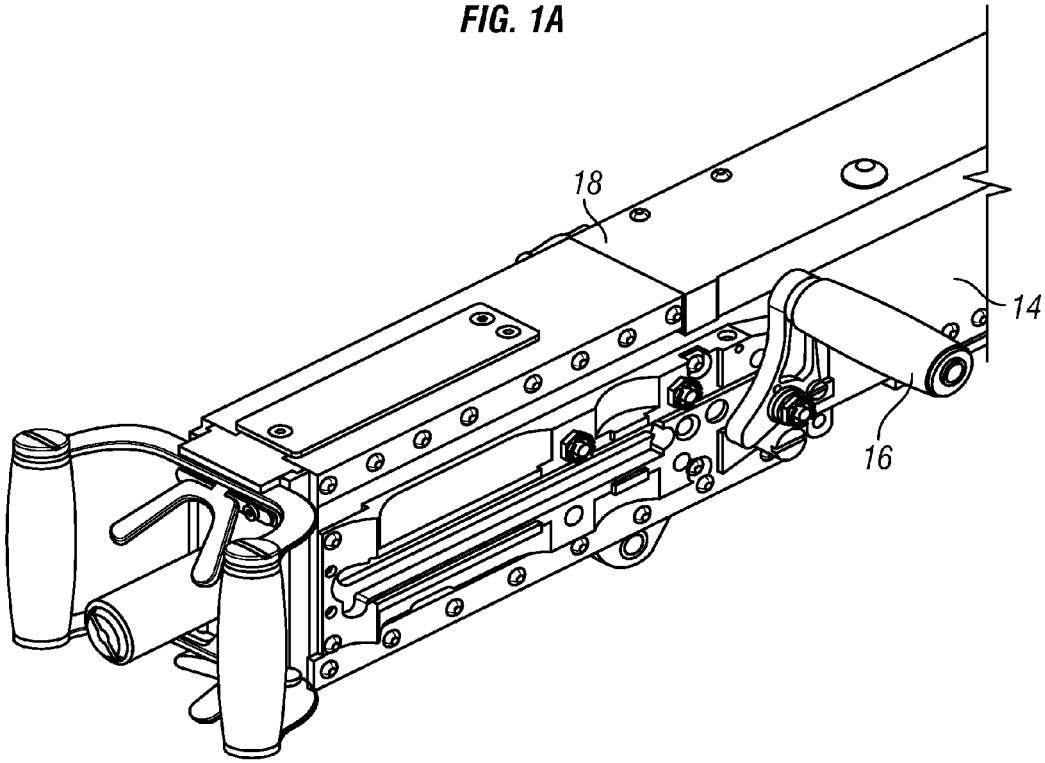
Figure 1C:
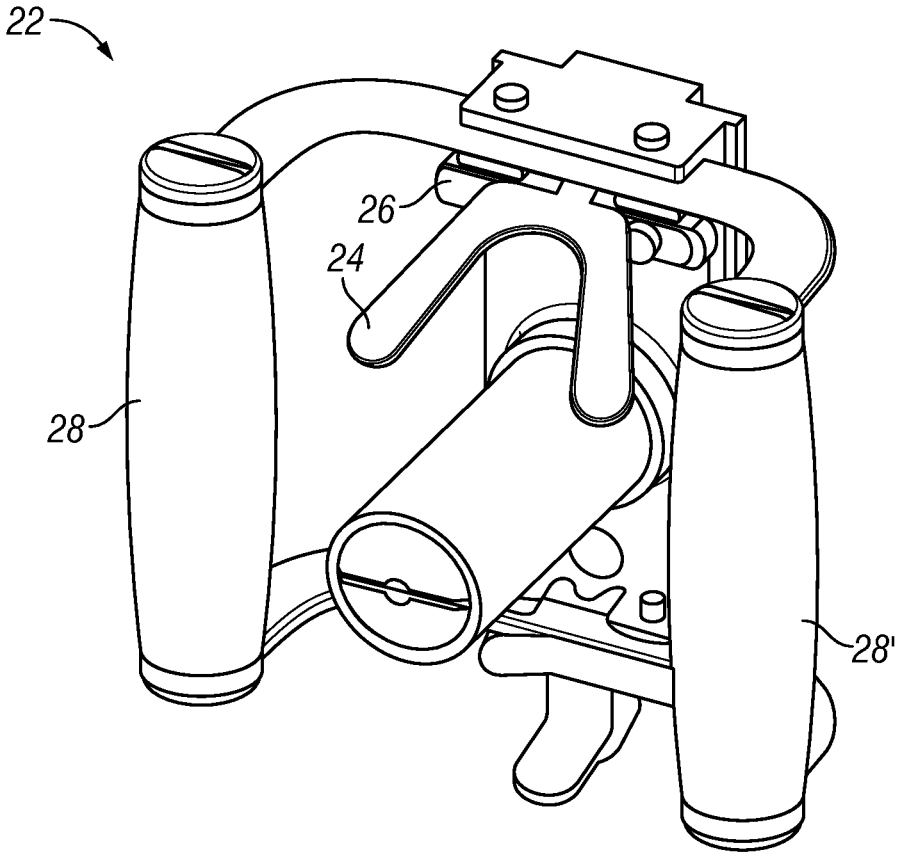
Figure 2A:
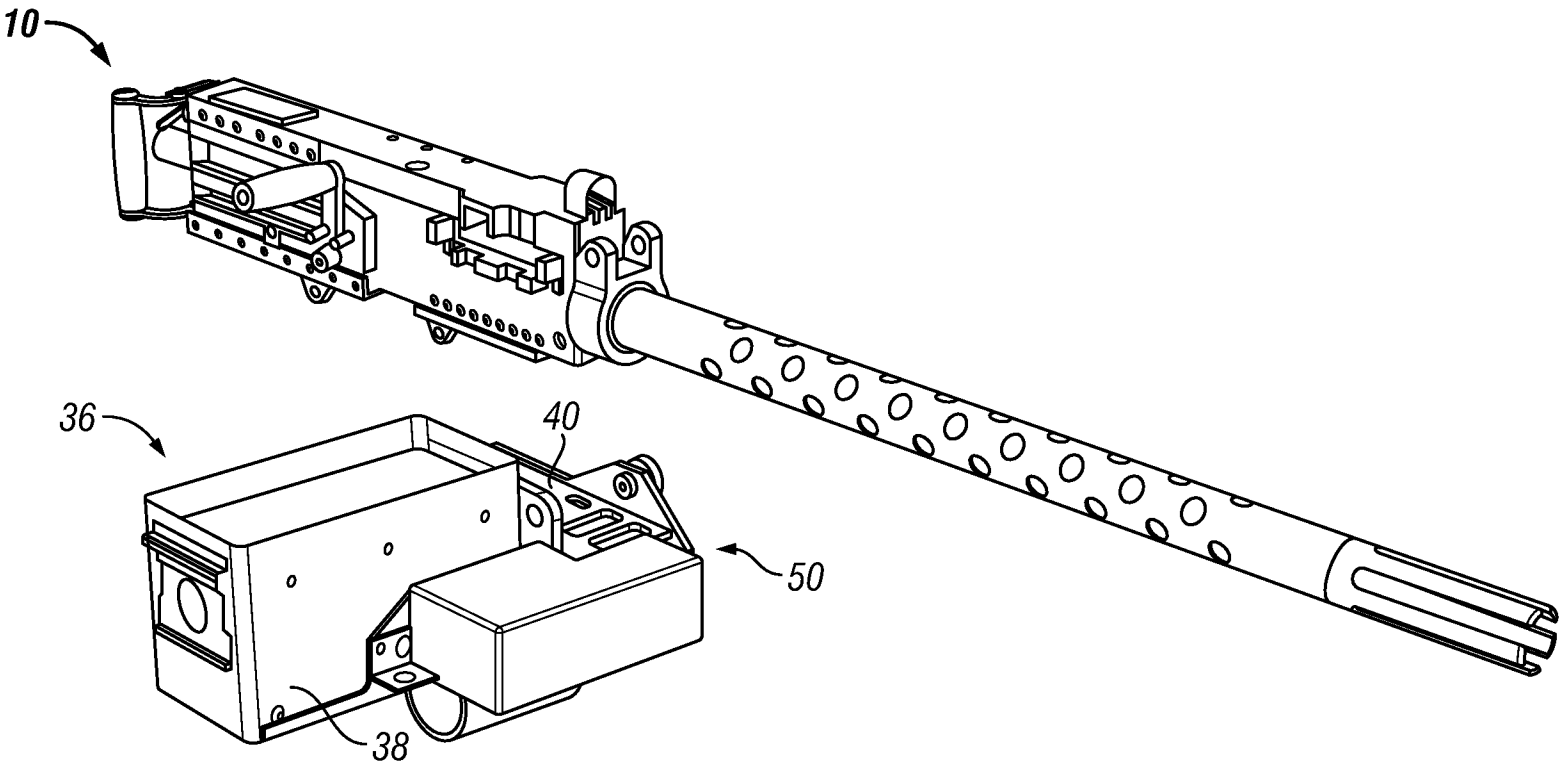
FIG. 2A-2C illustrate an embodiment of the present invention comprising a gun being mounted onto a gun active recoil unit.
Figure 2B:
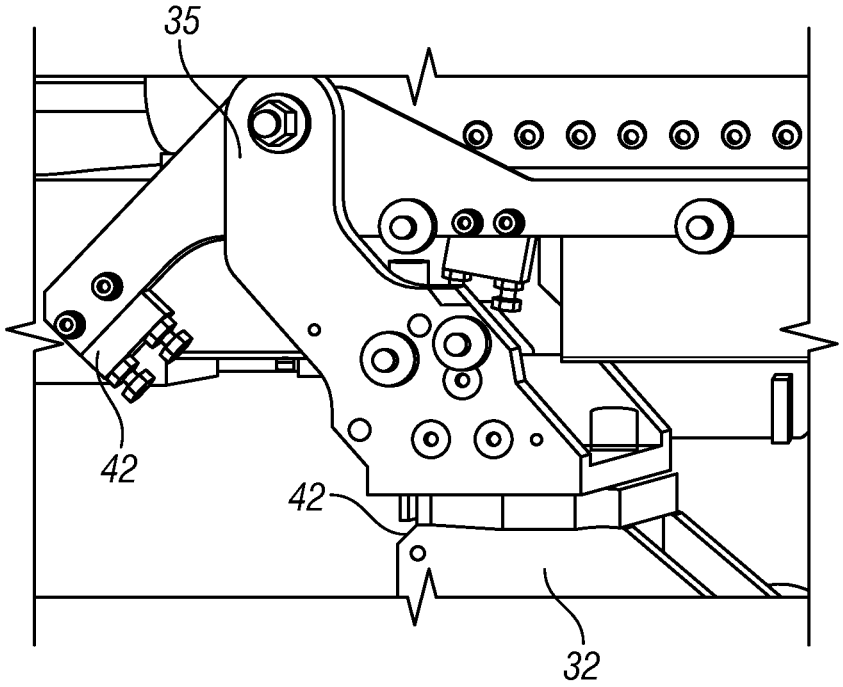
Figure 2C:
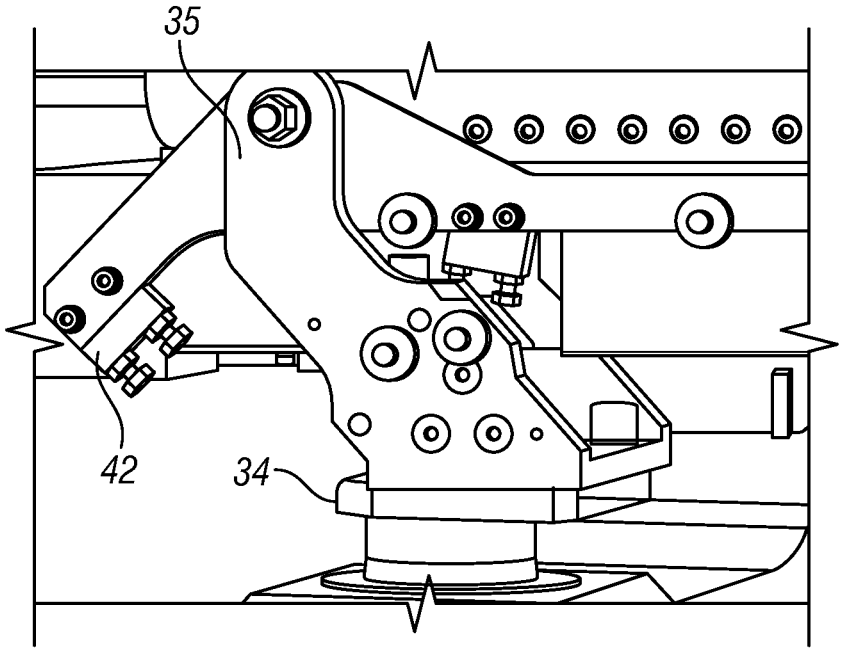

In one embodiment of the present invention and as illustrated in FIGS. 1A-1C, gun 10 preferably comprises a simulated weapon, preferably a simulated XM218 weapon that is unable to fire any type of rounds, is unable to chamber a round and cannot be modified to be an actual weapon. In an alternative embodiment, gun 10 is an actual weapon modified to be used with a gun active recoil unit 50.

Figure 1D:
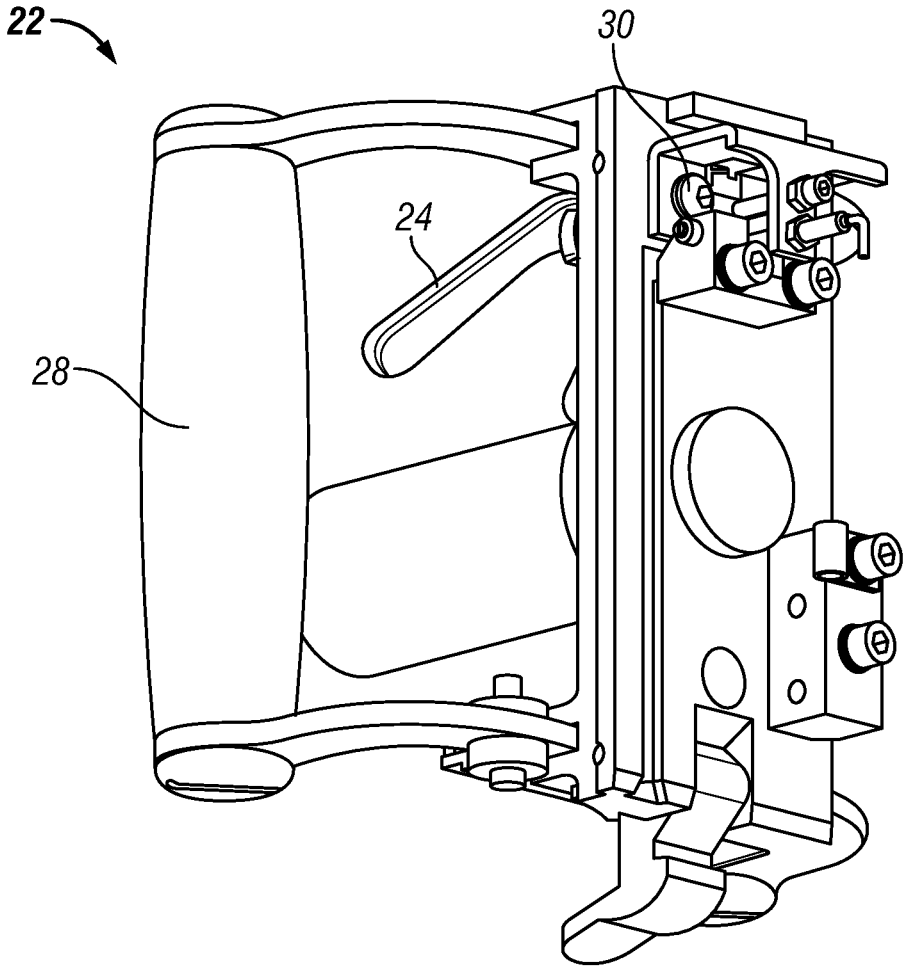

As illustrated in FIGS. 1A-1D, gun 10 of the present invention preferably comprises:

1. Weapon body 12, preferably made from a composite steel, stainless steel and/or aluminum;
2. Side plates 14, 14' (not shown) that preferably serve a structural and emulative function in a simulator;
3. Charging handle 16, illustrated in FIG. 1B, that preferably moves back and forth when pulled by a user to simulate the clearing/charging function for the user;
4. Top cover 18, preferably a metal top cover that is raised and lowered by a user to simulate loading or clearing of ammo belts. The top cover preferably has a latch release and flips up just as on an actual weapon;
5. Barrel assembly 20, preferably an aluminum or stainless steel barrel assembly, preferably simulates a barrel on gun 10 and is attached to a bolt protruding from the weapon body. The barrel assembly is preferably threaded and threads onto the bolt; and
6. Back plate assembly 22, as illustrated in FIG. 1C, preferably comprises trigger 24, safety 26, and grips 28, 28'. Trigger 24 is not limited to a traditional trigger but can also include a button, a touch pad, voice activation, and the like. In this embodiment, triggers 24 and safety 26 can be adjusted by a user. When depressed, trigger 24 preferably sends a position signal to a host computer, which in turn sends an activating signal to gun active recoil unit 50. As illustrated in FIG. 1D, trigger 24 preferably comprises adjustable hard stop 30 that limits its amount of travel. Hard stop 30 is preferably a socket head cap screw on back plate assembly 22. Trigger 24 further comprises a trigger switch that is preferably a threaded, barrel type proximity switch. The threads allow it to be adjusted along the full length of trigger 24.

A Dun Active Recoil Unit

Figure 3:
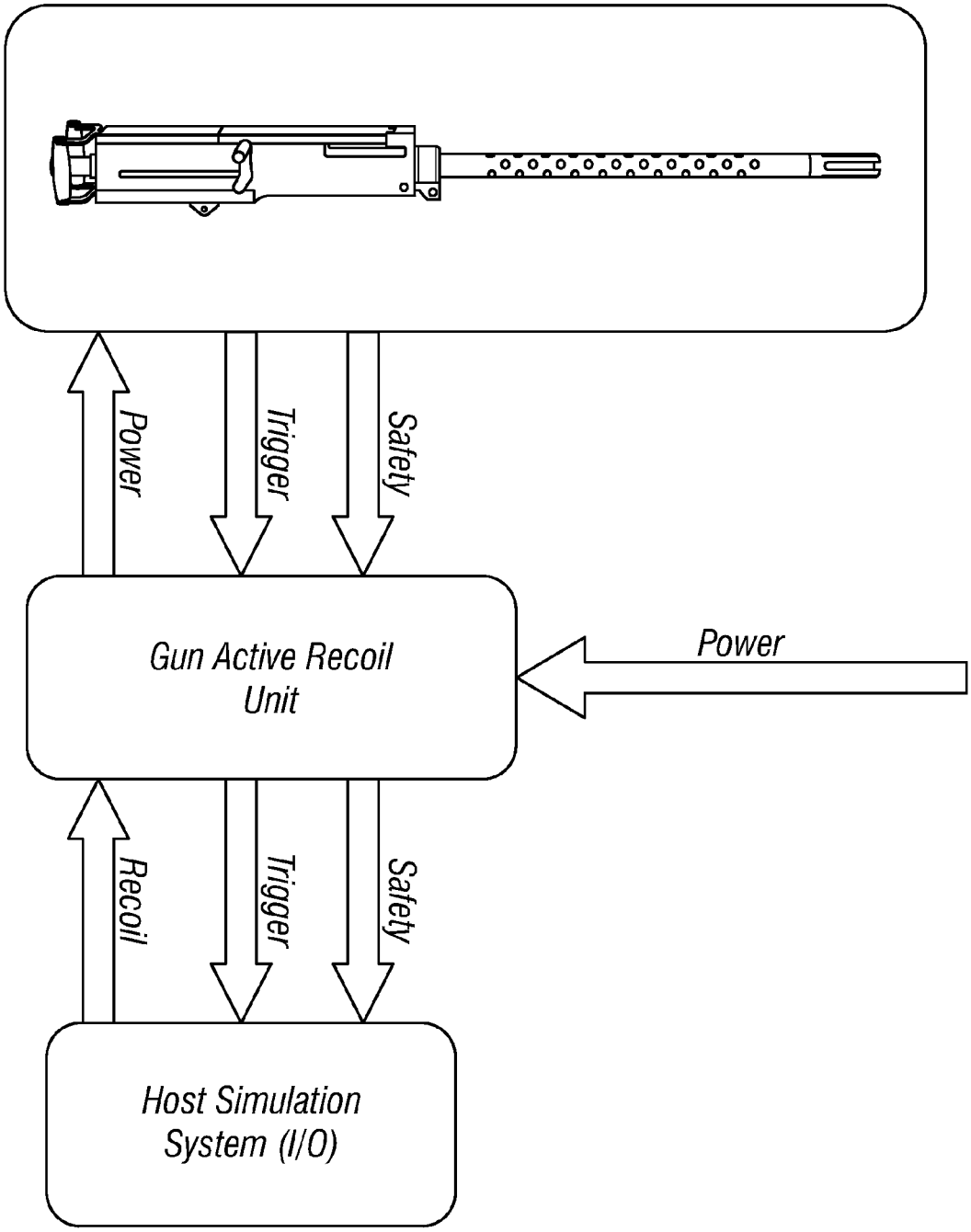
FIG. 3 illustrates a signal sequence of an embodiment of the present invention.
Figure 4:
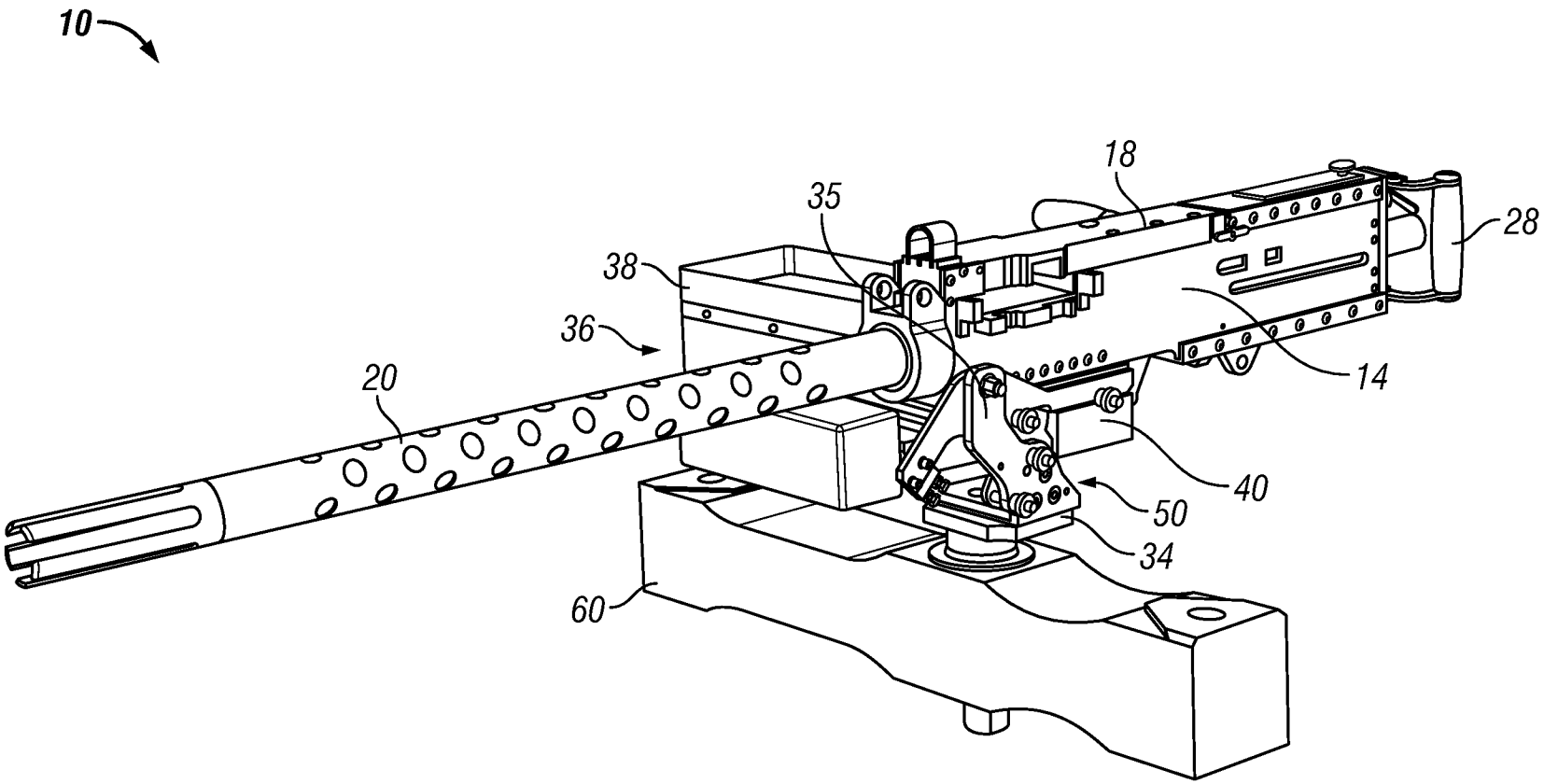
FIG. 4 illustrates an embodiment of the present invention comprising a gun and a gun active recoil unit mounted onto a window mount of a CH-46 aircraft.
Figure 5:
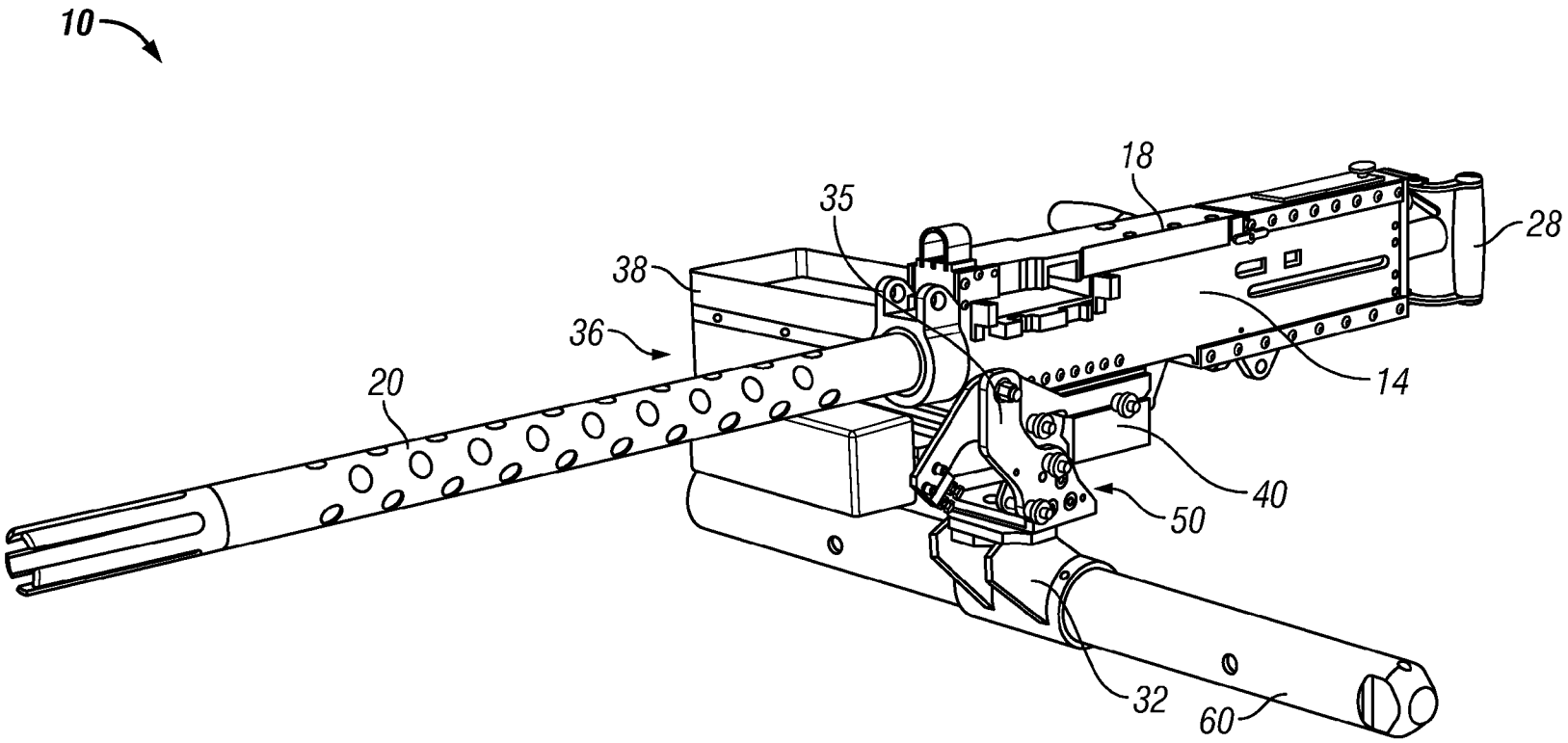
FIG. 5 illustrates an embodiment of the present invention comprising a gun and a gun active recoil unit mounted onto a window mount of a CH-53 aircraft.

In one embodiment of the present invention, and as illustrated in FIG. 3 gun active recoil unit 50 receives a signal from a host computer instructing it to simulate recoil forces on gun 10. Gun active recoil unit 50 is preferably adaptable for mounting to a plurality of aircraft by switching out mounting pintles. Mounting pintles can include but are not limited to pins, brackets, clamps, screws, bolts, threaded attachments, and combinations thereof. The mounting pintle supports a weapon (or unit with weapon). The pintle allows the rotation of the weapon system to aim in different directions. Pintles allow rotation in elevation, azimuth, or both. Pintles include provisions for travel stops to allow only the weapon to be fired in a safe direction. Pintle stops can include the shape of the pintle hitting part of the weapon or adjustable screws that hit part of the weapon.

As illustrated in FIG. 2A-2C, a gun active recoil unit 50 preferably comprises:

1. Pintles 32 and 34 for mounting onto different aircraft, for example the CH-53 and CH-46;
2. Gun mount assembly 35;
3. Electronic chassis 36 preferably located inside modified ammo container 38;
4. Slide tray 40 that moves forward and backward simulating recoil forces; and
5. Adjustable stops 42, preferably azimuth and elevation stops.

Figure 6:
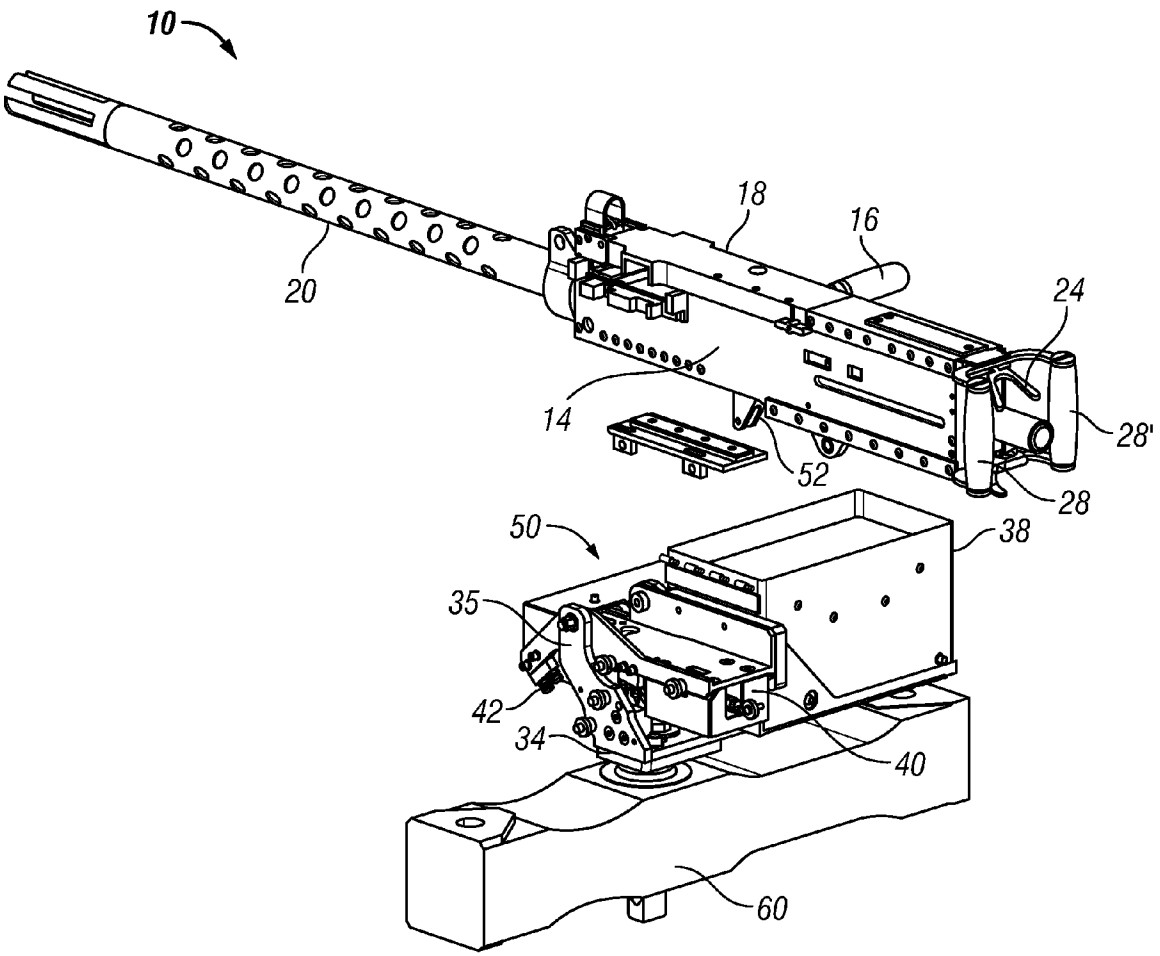
FIG. 6 illustrates assembly of a gun and a gun active recoil unit mounted onto a window mount of a CH-46 aircraft.
Figure 7:
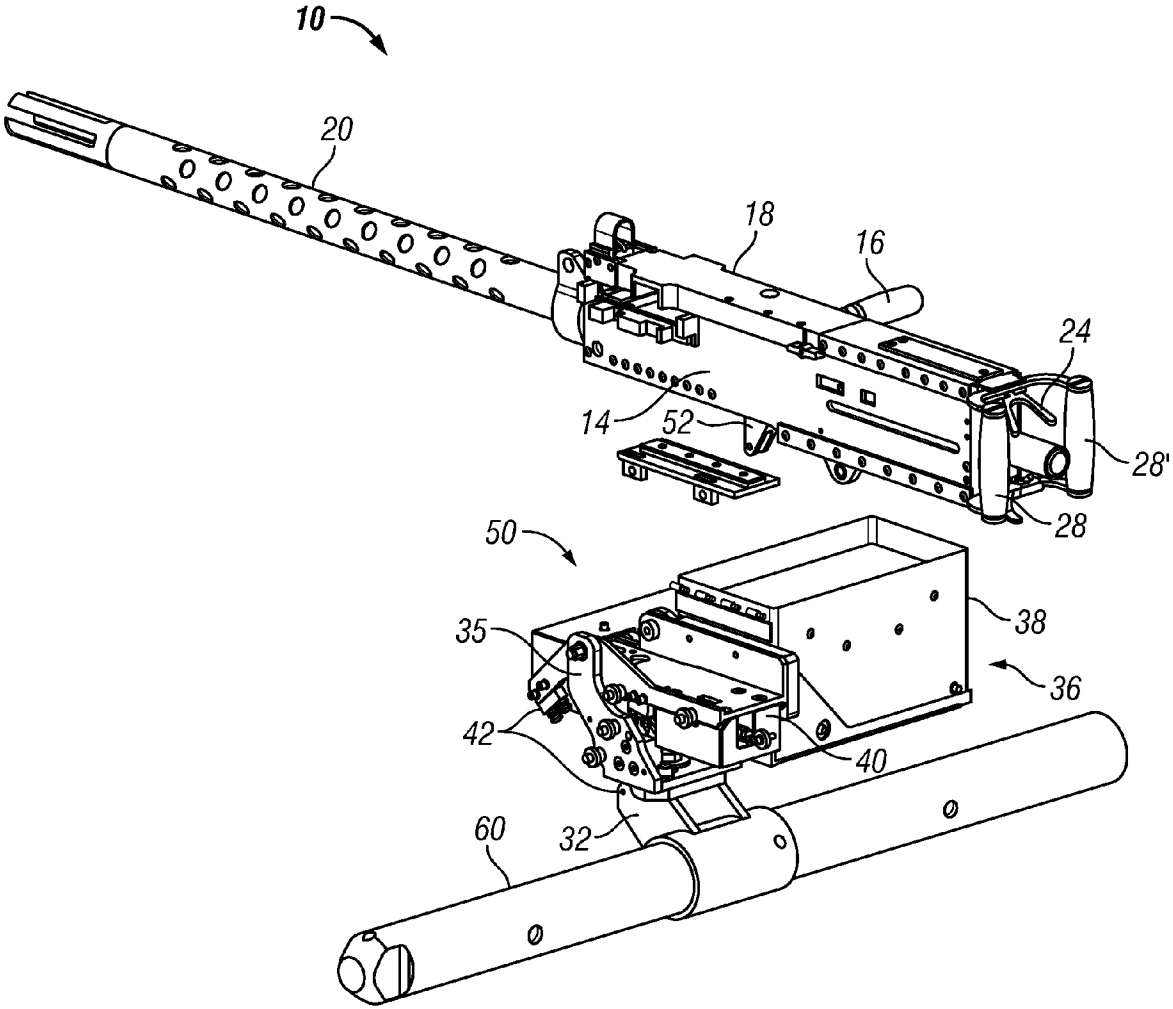
FIG. 7 illustrates assembly of a gun and a gun active recoil unit mounted onto a window mount of a CH-53 aircraft.

In this embodiment, gun (simulated, de-militarized or functional) 10 mounts to slide tray 40 via attachment 52, see FIGS. 6-7. Attachment 52 can comprise any attachment known in the art for attaching gun 10 to slide tray 40. Slide tray 40 slides fore and/or aft on linear bearings providing the feel of actual recoil without firing the weapon. This embodiment is electrically driven via a motor, preferably a rotary motor, and/or gearbox located in electronic chassis 36. Mechanical linkages connect slide tray 40 and the motor. Slide tray 40 preferably moves articulation from inside the weapon to an external mount. Slide tray 40 can use actual or simulated weapons with a minimum of modifications while producing the same recoil effect for a user. The mechanical linkages can include but are not limited to screws, bolts, welds, clamps, pins, tie rods, and rod-ends, bearings, pivots, bell-cranks, bushings, radial bearings and any combination thereof. Firing control algorithms are preferably burnt onto an on-board motor controller. This embodiment provides recoil without wearing on gun 10 or expending blank ammunition. This embodiment also prevents any bolt action from occurring. Thus, for this embodiment of the present invention there is no bolt action. Further, this embodiment of the present invention does not require electric solenoids. This embodiment moves slide tray 40 that gun 10 is mounted to and does not rely on mass/acceleration to create a force. Further, a weapon simulator of the present invention does not use compressed air for the recoil force and also does not use UHF or IR transmitters to send data from the gun to the host computer.

Gun 10 can be attached to gun active recoil unit 50 by using hardware, such as but not limited to bolts, nuts, washers, screws, combinations thereof and the like and/or quick release pins or any other method known in the art. Preferably, gun 10 is attached to gun active recoil unit 50 at two or more locations, one on each end of gun active recoil unit 50. The arrangement of the hardware or pin holes can be exactly like gun 10 allowing an actual unmodified gun to be mounted to gun active recoil unit 50.

Operation of an Embodiment of a Weapon Simulator

In one embodiment of the present invention, the weapon simulator responds to user input on the trigger. The weapon simulator also responds to electromechanical stimuli from gun active recoil unit 50. In this embodiment, and as illustrated in FIG. 3, when a user depresses trigger 24 on gun 10, an electronic signal is sent through gun active recoil unit 50 to a host computer. The host computer is preferably controlled by an instructor. Gun active recoil unit 50 preferably responds to signals from the host computer. The host computer preferably communicates with gun active recoil unit 50 through discrete and/or analog signals. The interface between gun active recoil unit 50 and the host computer is preferably through an Ethernet interface. The host computer interprets data and drives gun active recoil unit 50. When gun active recoil unit 50 receives fire commands from the host computer, it initiates electromechanical motions and simulates recoil caused by rapidly firing of ammunition via slide tray 40 of gun active recoil unit 50. In a further embodiment, if safety 26 has been activated by the user, trigger 24 will not depress, and a signal will be sent to the host computer telling it NOT to fire gun 10. However, in this embodiment, an instructor can override the safety setting to simulate "cook-off" rounds in gun 10.

In another embodiment of the present invention, gun active recoil unit 50 and gun 10 are reactive devices. They operate in response to signals sent from the host computer. In this embodiment, a user depresses trigger 24 that sends a signal through a gun active recoil unit 50 to the host computer. A gun active recoil unit 50 then responds to the signal from the host computer and begins simulating recoil forces upon gun 10. The host computer is preferably the controlling device regun active recoil unitdless of the source of the "initiate" signal. In this embodiment, nothing happens until the host computer sends the recoil signal to gun active recoil unit 50. The instructor can also initiate gun active recoil unit 50 and/or gun 10 activities through the host computer without any input from a user.

The host computer of the present invention may be implemented in any of a variety of hardware implementations. For example, the data processing can be performed by an appropriately programmed microprocessor, Application Specific Integrated Circuit (ASIC), Field Programmable Gate Array (FPGA), or the like, in conjunction with appropriate memory and bus elements. The methods of the invention can be implemented by appropriate software (embodied on a computer-readable medium, such as random-access memory (RAM), read-only memory (ROM), hard drives, Universal Serial Bus (USB) keys, and the like) coded in C++, Java, microcode, etc., as understood by one of ordinary skill in the art.

In a further embodiment of the present invention, the weapon simulator achieves maximum peak and sustains rates of fire required by a user. Varying rates of fire below the maximums required can be input into the host computer by the instructor. In this embodiment of the present invention, maximum rates of fire are approximately 750-1500 rounds per minute and are more approximately preferably 850-1000 rounds per minute and are most preferably approximately 950 rounds per minutes. In this embodiment, the recoil rate preferably matches the firing rate.

Another embodiment of the present invention comprises a cease fire signal. This signal is initiated by the host computer, regardless of whether or not the operator has ceased "firing" gun 10.

Another embodiment of the present invention comprises malfunctions controlled by the host computer. The types of malfunctions include but are not limited to:

1. Runaway—the host computer sends recoil signals to gun active recoil unit 50 regun active recoil unitdless of trigger 24 position;
2. Weapon misfire—the host computer does not send gun active recoil unit 50 recoil signals even when trigger 24 is depressed;
3. Weapon sluggishness—the host computer slows the rate at which the recoil signal is being sent to gun active recoil unit 50; and
4. Round Cook-off—the host computer sends a recoil signal to gun active recoil unit 50 without trigger 24 signal input.

In a preferred embodiment, the range of motion of the simulated weapon can be adjusted using azimuth and elevation, see FIGS. 6-7 illustrating adjustable elevation and azimuth stops 42.

In a further embodiment of the present invention, the weapon simulator comprises a replica of a XM218 weapon mount, preferably a mount for helicopters and fixed wing aircraft. In this embodiment, and as illustrated in FIGS. 4-7, gun active recoil unit 50 mounts to mount beam 60. The rate of fire for this embodiment is approximately 950 rounds per minutes. Recoil travel is preferably fixed at approximately 0.10"-0.5" and preferably at approximately 0.30". This embodiment includes adjustable elevation stops 42 appropriate for either the CH-46 or CH-53 RH door gunner position. This embodiment further includes adjustable azimuth stop 42 appropriate for the CH-53 RH door gunner.

An embodiment of the present invention can be delivered as a complete weapon system comprising a recoil unit, a simulated/demilitarized weapon, an Ethernet interface, and an input/output (I/O) system. In a further embodiment of the present invention, a weapon system can comprise additional features for the simulated/demilitarized weapon as well as the recoil assembly. The following features are additional and optional capabilities of a weapon system in accordance to an embodiment of the present invention:

1. A muzzle flash capability in the simulated/demilitarized weapon using Light Emitting Diodes (LEDs) for the visible and near infrared spectrum to support normal, unassisted line-of-sight training and night vision goggle training. The muzzle flash provides a visible cue of the weapon firing that corresponds to the weapon recoil motion;
2. Simulated ammunition that can be inserted and retained under the top cover of the weapon to simulate weapon loading. The ammunition system uses a solenoid and mechanical linkage to retain the ammunition belt. The belt can be released by receipt of a signal from the host computer. The ammunition belt then drops from the ammunition feed or optionally, is retracted back into the ammunition can. Release of the ammunition belt replicates an out of ammunition condition for the weapon;
3. The system is available for the M240 weapon type as well as the XM218;
4. The system accurately reproduces the weight and center-of-gravity (CG) of an actual weapon and mounts including a full ammunition box; and
5. The system replicates actual weapon mounts. Thus, it can be mounted on a range of vehicles and simulators including helicopters, HMMWV, Bradley Fighting Vehicles, M1 Abrams tank, etc.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A weapon simulator comprising:

a gun active recoil unit comprising a slide tray, and at least one electric motor to power the gun active recoil unit;

a gun mounted to said gun active recoil unit, said gun comprising a trigger; and a host computer in communication with said gun active recoil unit wherein the host computer is capable of dynamically altering a frequency of recoils per second when the weapon simulator is in use.

2. The weapon simulator of claim 1 wherein said gun is mounted to said slide tray.

3. The weapon simulator of claim 1 wherein said gun active recoil unit comprises a plurality of mounting pintles.

4. The weapon simulator of claim 1 wherein said gun active recoil unit comprises a plurality of adjustable stops.

5. The weapon simulator of claim 1 wherein said gun active recoil unit comprises an electronic chassis.

6. The weapon simulator of claim 1 wherein said gun comprises a replica weapon.

7. The weapon simulator of claim 1 wherein said gun comprises an actual weapon.

8. The weapon simulator of claim 1 wherein said gun comprises a safety.

9. The weapon simulator of claim 1 wherein said host computer comprises a plurality of malfunction capabilities for said weapon simulator.

10. The weapon simulator of claim 1 wherein said trigger comprises a hard stop to limit an amount of travel while said weapon simulator is activating.

11. The weapon simulator of claim 1 further comprising adjustable elevation and azimuth stops.

12. The weapon simulator of claim 1 further comprising a muzzle flash.

13. The weapon simulator of claim 1 further comprising simulated ammunition.

14. A method of simulating weapon recoil with a weapon simulator comprising:

providing a gun mounted to a gun active recoil unit;

squeezing a trigger on the gun to generate a signal;

transmitting the signal from the gun to a host computer in communication with the gun active recoil unit;

the gun active recoil unit responding to the signal from the host computer, wherein the host computer is capable of dynamically altering a frequency of recoils per second when the weapon simulator is in use; and simulating recoil via a slide tray disposed on the gun active recoil unit.

15. The method of claim 14 further comprising the gun active recoil unit initiating electromechanical motions.

16. The method of claim 14 wherein the transmitting step comprises processing the signal via an onboard computer.

17. The method of claim 14 further comprising the host computer initiating one or more malfunctions.

18. The method of claim 17 wherein the one or more malfunctions is selected from the group consisting of: a runaway recoil, weapon misfire, weapon sluggishness, and round cook-off.

19. The method of claim 14 further comprising signaling a cease fire.

20. The method of claim 14 further comprising activating a safety wherein the trigger will not depress.

21. The method of claim 20 further comprising the host computer overriding the safety to simulate cook-off rounds.

22. The method of claim 14 wherein the maximum rate of fire is between approximately 750-1000 rounds per minute.

23. The method of claim 14 further comprising adjusting the weapon simulator using azimuth and elevation.

24. The method of claim 14 further comprising an instructor initiating the gun active recoil unit and/or gun activity through the host computer.

25. A weapon simulator comprising:

a gun active recoil unit comprising a slide tray and at least one electric motor to power the gun active recoil unit;

a gun mounted to said gun active recoil unit, said gun comprising a trigger; and a processor for receiving instructions from a host computer which may receive information about said gun active recoil unit and command said gun active recoil unit through said processor to alter a frequency of recoils per second when the weapon simulator is in use.

* * * * *